US011045717B2

(12) United States Patent
Wei

(10) Patent No.: US 11,045,717 B2
(45) Date of Patent: Jun. 29, 2021

(54) BASKETBALL MACHINE AND CONTROL METHOD THEREFOR

(71) Applicant: PAOKAI ELECTRONIC ENTERPRISE CO., LTD., Kaohsiung (TW)

(72) Inventor: Ming-Shan Wei, Kaohsiung (TW)

(73) Assignee: PAOKAI ELECTRONIC ENTERPRISE CO., LTD., Kaohsiung (TW)

( * ) Notice: Subject to any disclaimer, the term of this patent is extended or adjusted under 35 U.S.C. 154(b) by 63 days.

(21) Appl. No.: 16/519,224

(22) Filed: Jul. 23, 2019

(65) Prior Publication Data

US 2020/0338440 A1 Oct. 29, 2020

(30) Foreign Application Priority Data

Apr. 24, 2019 (TW) ..... 10811433.0

(51) Int. Cl.
*A63F 7/20* (2006.01)
*A63F 7/06* (2006.01)
*A63F 7/30* (2006.01)

(52) U.S. Cl.
CPC ..... *A63F 7/0612* (2013.01); *A63F 7/0664* (2013.01); *A63F 7/30* (2013.01)

(58) Field of Classification Search
CPC ... A63B 69/0071; A63B 63/06; A63B 63/083; A63B 71/0622; A63B 71/0669; A63B 24/0075; A63B 2225/70; A63B 2024/0068; A63F 7/0612
See application file for complete search history.

(56) References Cited

U.S. PATENT DOCUMENTS 4,013,292 A * 3/1977 Cohen ..... A63B 69/0071 273/371
4,805,917 A * 2/1989 Cochran ..... A63B 47/025 273/397
5,330,175 A * 7/1994 Kim ..... A63B 24/0021 273/397
5,842,699 A * 12/1998 Mirando ..... A63B 63/06 273/317.3

(Continued)

FOREIGN PATENT DOCUMENTS

CN 201744169 U 2/2011

*Primary Examiner* — Lawrence S Galka
(74) *Attorney, Agent, or Firm* — Alan D. Kamrath; Karin L. Williams; Mayer & Williams PC

(57) ABSTRACT

A basketball machine includes a body having an inclined lane, a display configured to display a game having a plurality of challenges, a hoop including an engagement portion and an opening, a sensor configured to detect whether a ball has passed through the opening of the hoop, and a processor. The game has a first image layer showing a plurality of display areas, a reference object and a plurality of moving objects. The moving object moves towards and past the reference object. Each moving object has a bonus prize. The sensor generates a scoring signal when the detected result is positive. The processor calculates an accumulated number of times the scoring signal has been received and converts the accumulated number into an instant score. The processor determines whether the player qualifies as completing the current challenge, and controls the game to enter the next challenge when the determination is positive.

9 Claims, 6 Drawing Sheets

(56) References Cited

U.S. PATENT DOCUMENTS

| | | | | |
|---|---|---|---|---|
| 6,536,770 | B1 * | 3/2003 | Yang | A63B 63/06 273/317.3 |
| 7,201,676 | B2 * | 4/2007 | Rumfola, III | A63B 63/083 473/433 |
| 8,616,553 | B1 * | 12/2013 | Tsai | A63B 69/0071 273/317.3 |
| 10,220,281 | B2 * | 3/2019 | Luo | A63B 69/0071 |
| 10,596,436 | B1 * | 3/2020 | Campbell | A63B 69/407 |
| 2013/0005512 | A1 * | 1/2013 | Joseph | A63B 24/0075 473/431 |
| 2013/0106684 | A1 * | 5/2013 | Weast | A63B 24/0062 345/156 |
| 2015/0051026 | A1 * | 2/2015 | Halliburton | A63B 71/0669 473/480 |
| 2016/0325167 | A1 * | 11/2016 | Constantin | A63B 69/0071 |

* cited by examiner

BASKETBALL MACHINE AND CONTROL METHOD THEREFOR

The application claims the benefit of Taiwan application serial No. 108114330, filed on Apr. 24, 2019, and the entire contents of which are incorporated herein by reference.

BACKGROUND OF THE INVENTION

1. Field of the Invention

The present invention generally relates to an amusement machine and, more particularly, to a basketball machine that includes a display for displaying digital images and a control method for the basketball machine.

2. Description of the Related Art

A conventional basketball machine includes a simulated hoop and requires the player to complete individual challenges within a time limit (in seconds). Referring to FIG. 1, the conventional basketball machine 9 includes a body 91, a backboard 92, a basket 93 and a monitoring device 94. The body 91 includes a base 911 and a rear board 912 fixed to the rear end of the base 911. The backboard 92 is coupled with the rear board 912. The basket 93 is positioned at one side of the backboard 92 opposite to another side of the backboard 92 where the rear board 912 is positioned. The monitoring device 94 is attached to the backboard 92 and includes a detection module 941 and a display module 942. The detection module 941 is configured to detect whether the ball has passed through the basket 93. If so, the score is added up and displayed on the display module 942. The display module 942 can also display the number of seconds remaining to remind the player of the remaining time. An embodiment of such a conventional basketball machine is seen in China Utility Model No. 201744159.

However, the gameplay as provided by the conventional basketball machine is monotonous, such that the users tend to lose interest in playing the game. Therefore, it is necessary to improve the conventional basketball machine.

SUMMARY OF THE INVENTION

It is therefore the objective of this invention to provide a basketball machine which displays a bonus mode on a display to provide a novel way of playing the game.

It is another objective of this invention to provide a control method for the basketball machine which enhances the diversity of the game and thereby promotes the player's passion for playing the game.

In an aspect, a control method for a basketball machine is disclosed. The basketball machine includes a body, a display, a hoop, a sensor and a processor. The display and the hoop are connected to the body. The sensor is connected to the hoop. The processor is electrically connected to the display and the sensor. The control method includes activating the basketball machine by the processor, controlling the display to display a game having a plurality of challenges by the processor, generating a plurality of display areas, a reference object and a plurality of moving objects on a first image layer of the game by the processor, setting a bonus prize for each of the plurality of moving objects in a random manner by the processor, controlling the plurality of moving objects to move towards and past the reference object by the processor, detecting whether there is a ball passing through an opening of the hoop by the sensor, generating a scoring signal by the sensor when the detected result is positive, calculating an accumulated number of times the scoring signal has been received by the processor, converting the accumulated number into an instant score by the processor, determining whether the scoring signal has been received by the processor within a predetermined period of time following the moment of contact between the reference object and one of the plurality of moving objects, crediting a player with the bonus prize of the one of the plurality of moving objects when the determined result is positive, adding the bonus prize of the one of the plurality of moving objects to the instant score of the player by the processor to generate a game data, displaying the game data on the plurality of display areas by the processor, determining whether the game data reflects a condition qualifying as completing a current one of the plurality of challenges by the processor, and controlling the basketball machine to enter a next one of the plurality of challenges following the current challenge by the processor when the game data reflects the condition qualifying as completing the current challenge.

In another aspect, a basketball machine includes a body having an inclined lane, a display connected to the body and configured to display a game having a plurality of challenges, a hoop including an engagement portion engaged with the body and having an opening, a sensor connected to the hoop and configured to detect whether a ball has passed through the opening of the hoop, and a processor electrically connected to the display and the sensor. The game has a first image layer showing a plurality of display areas, a reference object and a plurality of moving objects. The plurality of moving objects moves towards and past the reference object. Each of the plurality of moving objects has a bonus prize generated in a random manner. The sensor generates a scoring signal when the detected result is positive. The processor calculates an accumulated number of times the scoring signal has been received and converts the accumulated number into an instant score. The processor determines whether a game data reflects a condition qualifying as completing a current one of the plurality of challenges according to the instant score and the bonus prize. The processor controls the game to enter a next one of the plurality of challenges following the current one of the plurality of challenges when the determined result is positive.

Based on the above, the basketball machine and the control method therefor according to the invention can display the game, including the reference object and the plurality of moving objects, on a display while controlling the plurality of moving objects to move towards and past the reference object. In this regard, the processor credits the player with the bonus prize when determining that the scoring signal has been received within a predetermined period of time following the moment of contact between the moving object and the reference object. Accordingly, the basketball machine and the control method therefor according to the invention can improve the entertaining effect in playing the game.

In a form shown, the control method further includes increasing a required score of the next one of the plurality of challenges and a movement speed, a quantity and the bonus prize of each of the plurality of moving objects by the processor. Thus, the control method according to the invention is able to enhance the diversity of the game.

In the form shown, the bonus prize of the one of the plurality of moving objects is a number N that is randomly determined. The instant score of the player is increased by N points and/or an instant amount of token tickets of the player is increased by the number N, as performed by the processor. Thus, the game is more challenging.

In the form shown, the game further includes a second image layer under the first image layer. An animated background is displayed on the second image layer. Thus, the control method according to the invention permits the user to play the game while watching the animated background, enhancing the entertaining effect in playing the game.

In the form shown, the bonus prize of another of the plurality of moving objects is set as a progressive jackpot prize by the processor when the instant score of the player reaches a required score of a final one of the plurality of challenges. When the scoring signal has been received by the processor within the predetermined period of time following the moment of contact between the reference object and the other of the plurality of moving objects, the player is credited with the progressive jackpot prize as well as a number of points and/or a number of token tickets. Thus, the control method according to the invention is able to promote the player's passion for playing the game as the player wishes to win the jackpot prize. Thus, the game is more challengeable.

In the form shown, the processor determines whether the scoring signal has been received within a predetermined period of time following the moment of contact between the reference object and one of the plurality of moving objects. The processor credits a player with the bonus prize of the one of the plurality of moving objects when the determined result is positive. The processor adds the bonus prize of the one of the plurality of moving objects to the instant score of the player to generate a game data. The processor displays the game data on the plurality of display areas. Thus, the basketball machine according to the invention is able to limit the ball in the space between the stopper board and the rear end of the base, preventing someone from taking the ball away. Advantageously, the accommodation of the ball is safe.

In the form shown, the body includes a stopper board movably disposed in a recess of the inclined lane, and the stopper board is able to retract in or extend out of the recess of the inclined lane. Thus, the basketball machine according to the invention is able to limit the ball in the space between the stopper board and the rear end of the base, preventing someone from taking the ball away. Advantageously, the accommodation of the ball is safe.

In the form shown, the basketball machine further includes a stopper member including a first stopper unit, and the first stopper unit is coupled with a backboard and disposed over the opening of the hoop. Thus, the basketball machine according to the invention is able to prevent the ball, when hitting the hoop, from bouncing out of the basketball machine from above.

In the form shown, the stopper member further includes a second stopper unit sandwiched between two lateral boards of the body, and a bottom of the second stopper unit is spaced from a surface of the inclined lane at a minimum gap allowing for passage of the ball. Thus, the basketball machine according to the invention is able to prevent the ball, when hitting the hoop, from bouncing out of the basketball machine from above.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
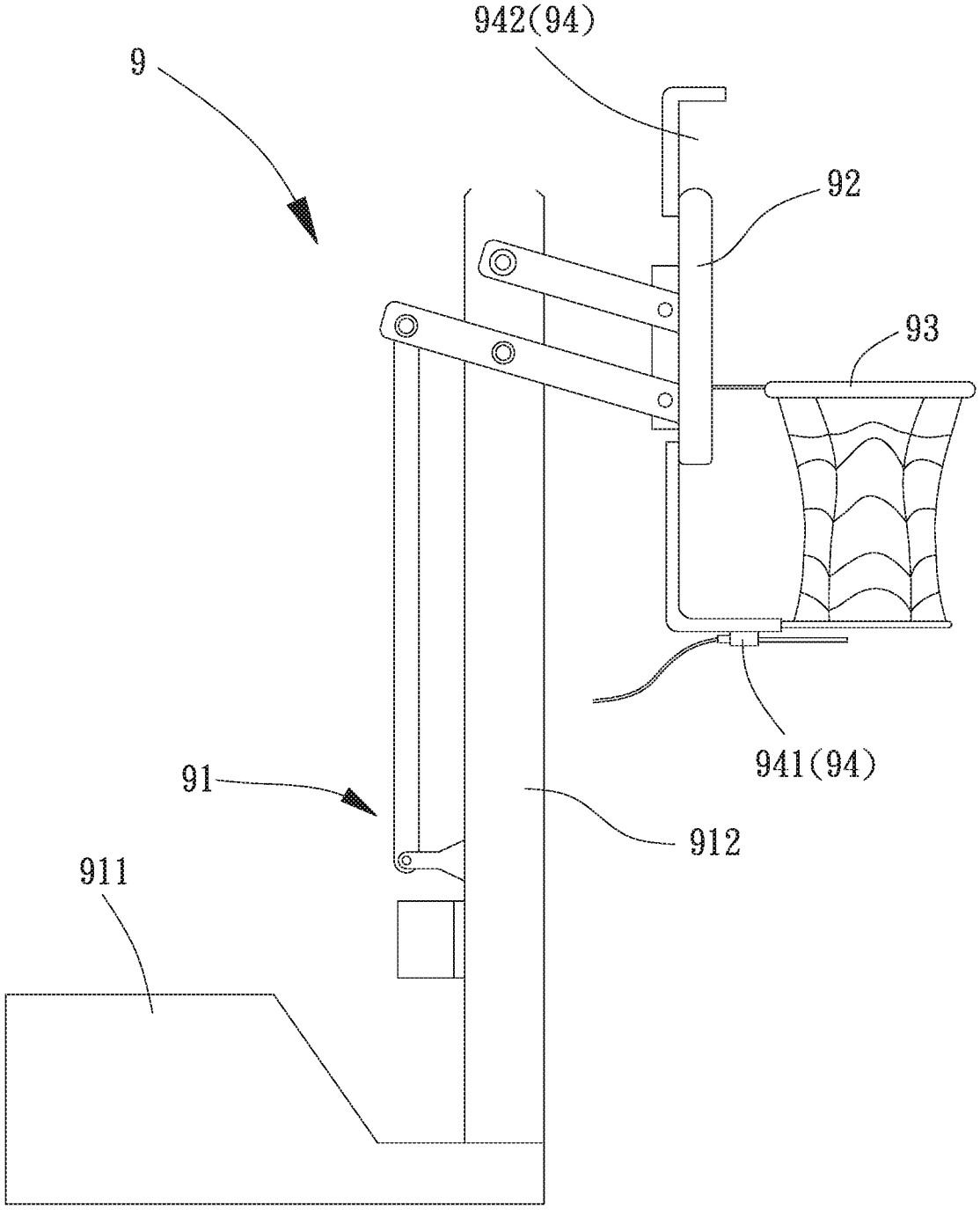
FIG. 1 PRIOR ART
FIG. 1 shows a conventional basketball machine.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
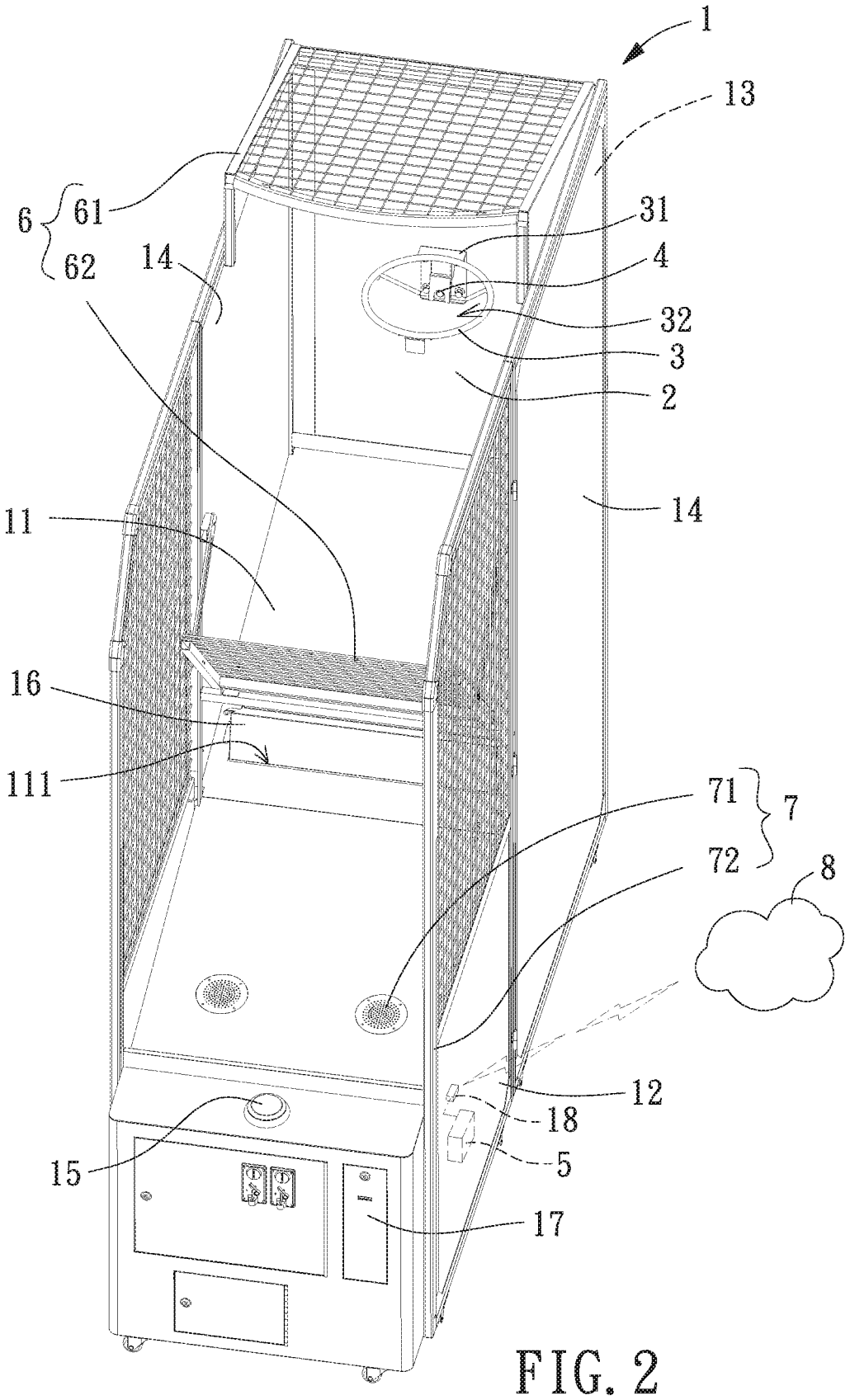
FIG. 2 is a perspective view of a basketball machine according to a preferred embodiment of the invention.

FIG. 2 shows a basketball machine according to an embodiment of the invention, which includes a body 1, a display 2, a hoop 3, a sensor 4 and a processor 5. The display 2 and the hoop 3 are connected to the body 1. The sensor 4 is mounted to the hoop 3. The processor 5 is electrically connected to the display 2 and the sensor 4.

The body 1 includes an inclined lane 11. In this embodiment, the inclined lane 11 is atop a base 12 and leads down to the front side of the basketball machine. The body 1 includes a backboard 13 and two lateral boards 14 that jointly delimit the inclined lane 11. The backboard 13 is disposed at the rear of the base 12. The two lateral boards 14 are respectively disposed at two lateral sides of the base 12 opposing to each other. Preferably, the base 12 includes an operating portion 15 which may be disposed at the front end of the base 12. The operating portion 15 generates a start signal to activate the basketball machine. The structure of the operating portion 15 is not limited; the operating portion 15 is a button in this embodiment. The basketball machine may further include a stopper board 16 movably retracted in a recess 111 of the inclined lane 11. Preferably, the recess 111 is arranged substantially at the center of the inclined lane 11. The stopper board 16 can remain retracted in the recess 111 of the inclined lane 11, and can extend out of the recess 111 when required. The basketball machine may further include a token dispenser 17 that dispenses token tickets that can be redeemed for services or goods.

Figure 3:
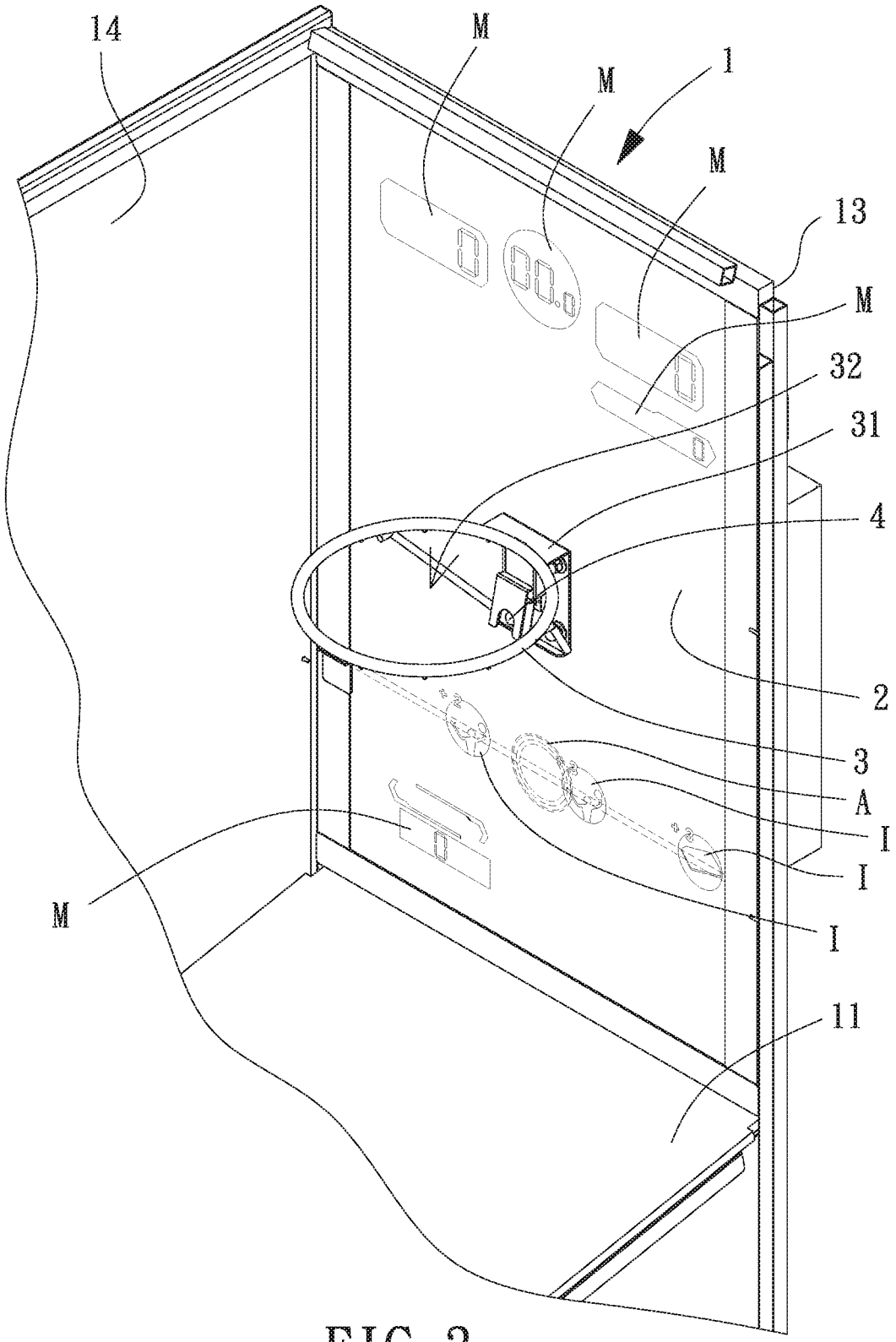
FIG. 3 is a partial, enlarged view of the basketball machine according to the preferred embodiment of the invention.

Referring to FIG. 3, the display 2 is mounted to the body 1. Preferably, the display 2 is mounted to the front of the backboard 13 for displaying the game. The display 2 may be a liquid crystal display, for example. The background of the game includes a first image layer and a second image layer. The first image layer includes a plurality of display areas M, a reference object A, and a plurality of moving objects I. The plurality of display areas M displays a game data including the instant score of the player, the highest score in the record, the number of token tickets of the player, the remaining time as well as the number of plays remaining. However, this is not used to limit the invention. The reference object A is stationary in this embodiment, but this is not used to limit the invention. The location of the reference object A in the first image layer is not limited. In an embodiment, the reference object A is located in an upper area of the first image layer. The plurality of moving objects I is randomly generated on the first image layer and moves towards and past the reference object A. Each of the plurality of moving objects I contains a bonus prize which is a random number N. The second image layer is below the first image layer and is used to display an animated background.

The hoop 3 includes an engagement portion 31 fixed to the body 1; the engagement portion 31 is preferably fixed to the front of the backboard 13. The hoop 3 includes an opening 32 having a dimension allowing for passage of the ball.

The sensor 4 is mounted to the hoop 3 and detects whether the ball has passed through the opening 32. If so, the sensor 4 generates a scoring signal. The sensor 4 may be an infrared sensor but is not limited thereto.

The processor 5 is electrically coupled to the operating portion 15, the stopper board 16, the token dispenser 17, the display 2 and the sensor 4. The processor 5 may be any electronic device that is able to store data, generate signals and perform arithmetic calculations, such as a programmable logic controller (PLC), a digital signal processor (DSP), a microcontroller unit (MCU) or any circuit board having the above functions. After the operating portion 15 generates the start signal, the processor 5 retracts the stopper board 16 in the inclined lane 11 and then controls the basketball machine to start the game. During the game, the processor 5 calculates an accumulated number of times the scoring signal has been received and converts the number into a score. In this regard, the processor 5 determines whether the player qualifies as completing the challenge based on the converted score as well as the obtained bonus prize. If so, the processor 5 controls the basketball machine to enter the next challenge.

In other words, the processor 5 determines whether the scoring signal has been received within a predetermined period of time following the moment of contact between the moving object I and the reference object A. If the determined result is positive, the player is credited with the bonus prize specified by said moving object I. The processor 5 adds the bonus prize (N points) to the instant score of the player to generate the game data and displays the game data in the plurality of display areas M. In this regard, the processor 5 is able to control the token dispenser 17 to dispense a number of token tickets according to the total score specified in the game data. Likewise, the processor 5 determines whether the specified score reaches the threshold required for completing the challenge. If the determined result is positive, the processor 5 controls the basketball machine to enter the next challenge. If the determined result is negative, the processor 5 controls the stopper board 16 to extend out of the inclined lane 11, limiting the ball in the space between the stopper board 16 and the rear end of the base 12. In this situation, the processor 5 also stops the basketball machine.

The basketball machine according to the invention further includes a stopper member 6 having a first stopper unit 61 and a second stopper unit 62. The outline and material of the stopper member 6 are not limited. For example, the stopper member 6 may be a board made of tempered glass. The first stopper unit 61 is coupled with and disposed over the backboard 13 and extends towards the front side of the base 12. The first stopper unit 61 is preferably disposed above the hoop 3 to prevent the ball, when hitting the hoop 3, from bouncing out of the basketball machine from above. The second stopper unit 62 is sandwiched between the two lateral boards 14. The bottom of the second stopper unit 62 is spaced from the surface of the inclined lane 11 at a minimum gap allowing for passage of the ball.

The basketball machine according to the invention further includes an acousto-optical unit 7 coupled with the body 1 and electrically connected to the processor 5. The acousto-optical unit 7 includes a speaker 71 and a plurality of light strips 72 for displaying music and emitting light, respectively. In this embodiment, the plurality of light strips 72 is mounted to the edges of the backboard 13, the two lateral boards 14 and the first stopper unit 61. However, the arrangement of the plurality of light strips 72 is not limited thereto.

The basketball machine according to the invention may further include a transmission interface 18 and a game server 8. The transmission interface 18 is electrically coupled to the processor 5 and the game server 8. The transmission interface 18 is configured to send a request for connection to the game server 8. The transmission interface 18 is a wired or wireless transmission medium, such as a pair of twisted wires, a coaxial cable, a fiber optic cable, an infrared device or a Bluetooth device and so on.

The game server 8 is any computer with high processing capability and can be accessed through internet by multiple users at the same time, such as a server dedicated for use by a workgroup, a department or an enterprise. The game server 8 is configured to send a control signal to at least two basketball machines that sent the requests for connection to the game server 8, and controls the basketball machines to activate at the same time. In this regard, the game server 8 preferably adds the respective bonus prize (N points) to the instant score of the corresponding basketball machine, or subtracts the bonus prize (N points) of one of the basketball machines from the score of another of the basketball machines as an attack to the player operating the other of the basketball machines. The game server 8 can also do both options. However, the above is not used to limit the invention.

Figure 4:
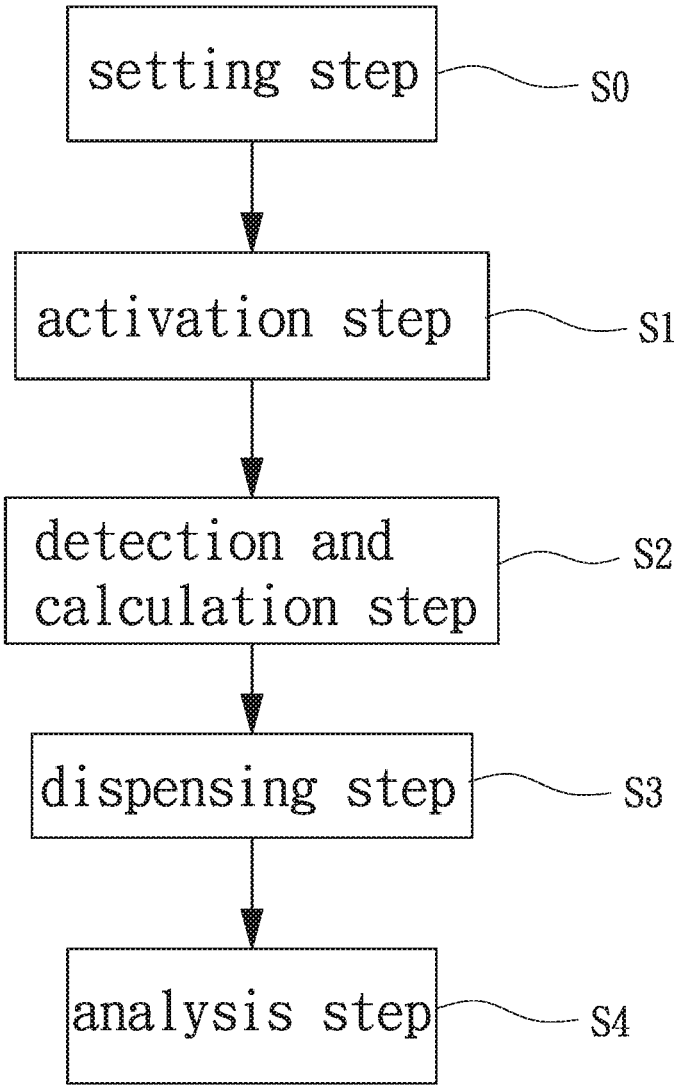
FIG. 4 shows a flowchart of a control method for the basketball machine of the preferred embodiment of the invention.

FIG. 4 shows a flowchart of a control method for the basketball machine according to the invention. The control method includes an activation step S1, a detection and calculation step S2, a dispensing step S3 and an analysis step S4.

The activation step S1 is configured to activate the basketball machine and to display the game on the display 2 as performed by the processor 5. Preferably, the activation step S1 is further configured for the player to select the mode of the game, which is a single-player mode or an on-line mode (multiple players). Specifically, when the player selects the single-player mode, the operating portion 15 generates and sends a setting signal to the processor 5 setting the basketball machine as the off-line mode.

After the start signal is received by the operating portion 15, the processor 5 controls the basketball machine to start the game. Then, the processor 5 generates a plurality of display areas M, a reference object A and a plurality of moving objects I on a first image layer of the game. The plurality of moving objects I is generated in a random manner. The processor 5 sets a bonus prize for each moving object I in a random manner and controls the moving object I to move towards and past the reference object A. The bonus prize is a number N that is randomly determined. In this regard, the instant score of the player can be increased by N points and/or the instant amount of the token tickets of the player can be increased by the number N as specified by the bonus prize. The number N of the bonus prize can be set by the processor 5. In a non-limiting example, the processor 5 can increase the instant score of the player by N points and/or the instant amount of the token tickets of the player by the number N, or can multiply the instant score and/or the instant amount of the token tickets of the player by the number N. In this embodiment, the number N can be 3, 4, 5 or 10, but is not limited thereto.

Figure 5:
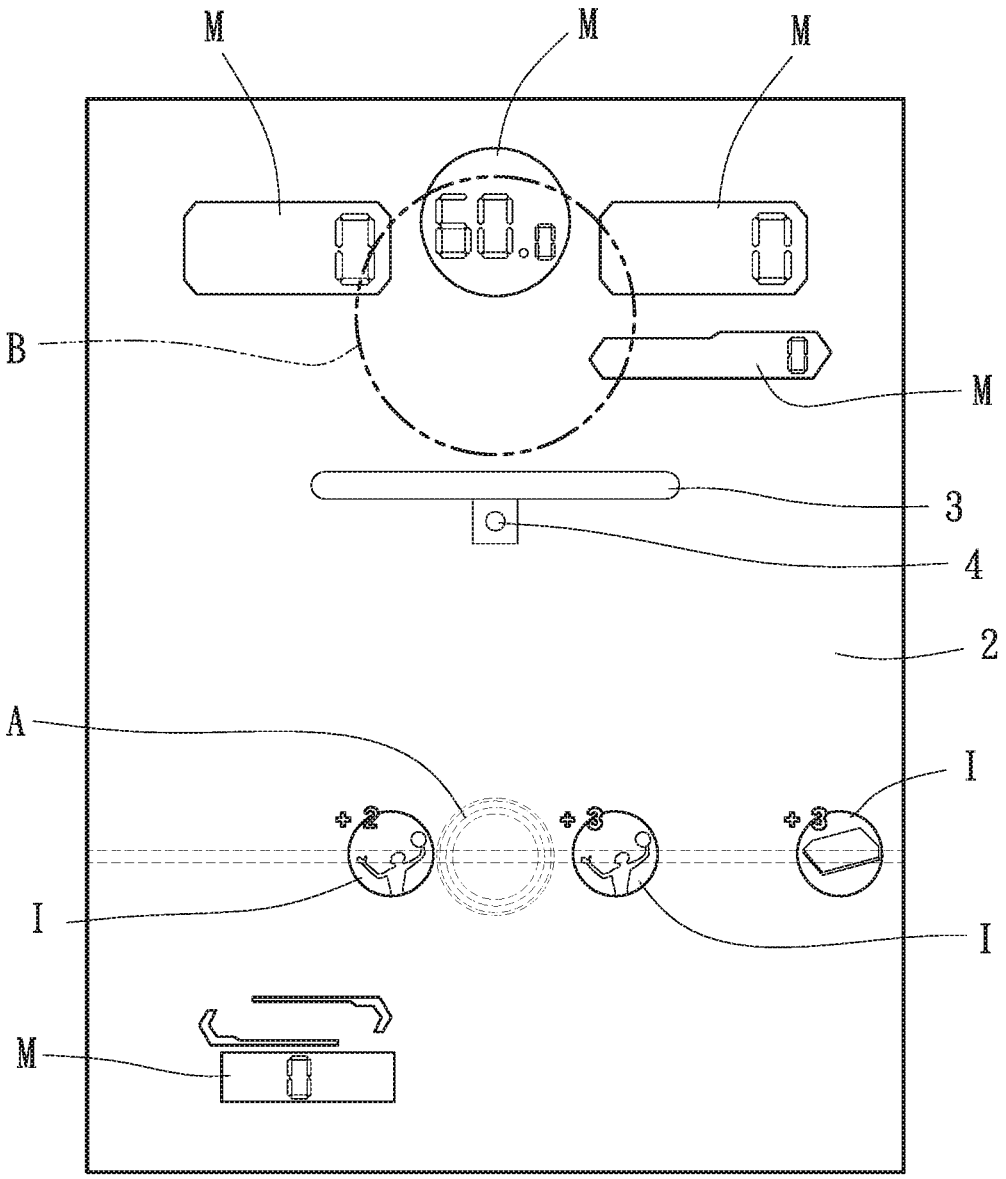
FIG. 5 is a front view of the basketball machine showing that the ball has not yet passed through the hoop.
Figure 6:
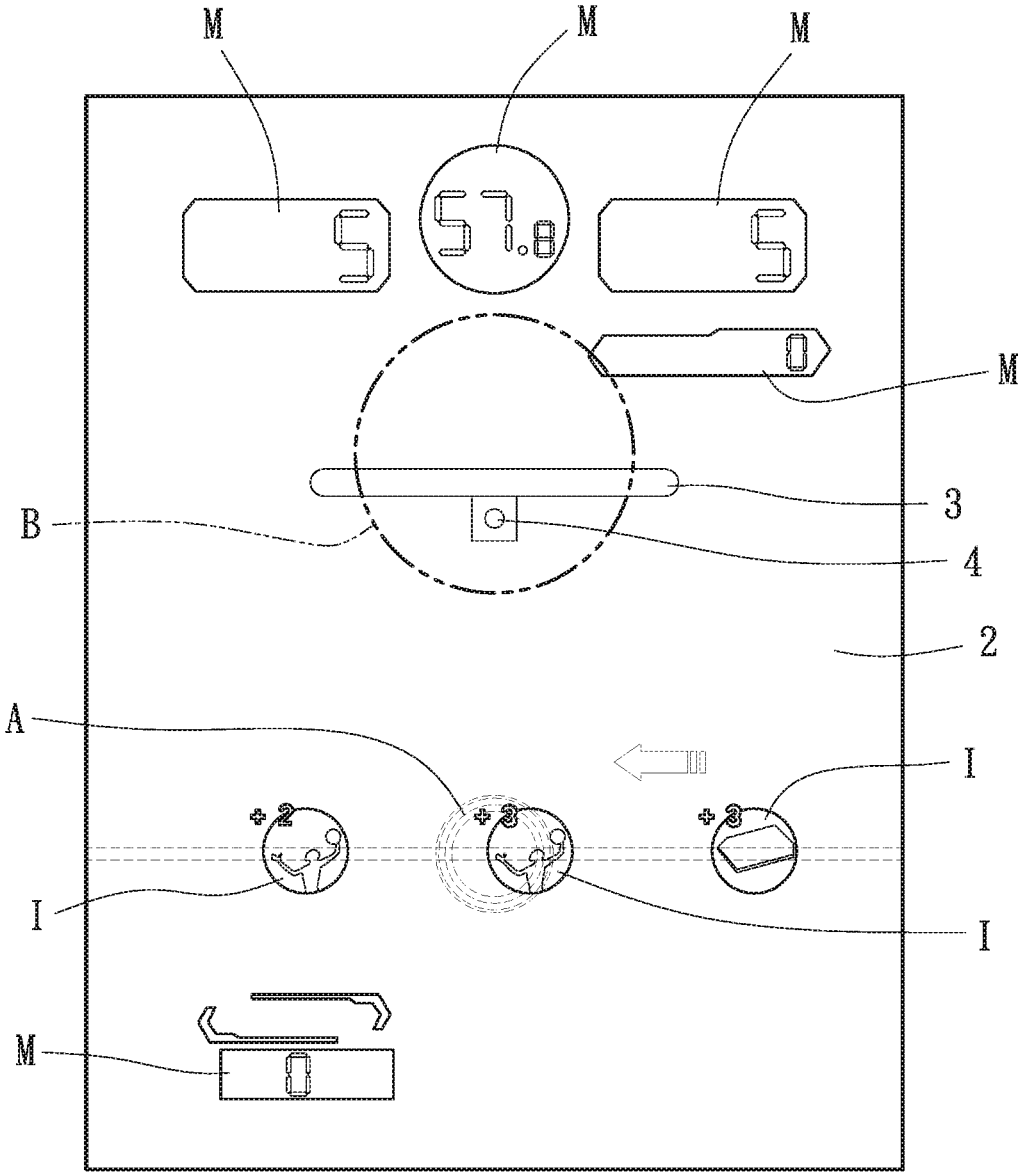
FIG. 6 is a front view of the basketball machine showing that the moving object is in contact and overlapped with the reference object.

Referring to FIGS. 5 and 6, the detection and calculation step S2 is configured to detect whether the ball B has passed through the opening 32 of the hoop 3 via the sensor 4. If so, a scoring signal is generated. The processor 5 calculates an accumulated number of times the scoring signal has been received and converts the number into a score. The conversion ratio of the accumulated number to the score can be adjusted by the processor 5. The conversion ratio may be 1:1 or 1:2, but is not limited thereto. In this embodiment, the conversion ratio is 1:2. In this regard, the processor 5 determines whether the scoring signal has been received within a predetermined period of time following the moment of contact between the moving object I and the reference object A. If so, the player is credited with the bonus prize specified by the moving object I. The predetermined period of time may be the duration of time from the moment the moving object I initially makes contact with the reference object A to the moment the moving object I completely passes through (off contact with) the reference object A. The processor 5 can add the bonus prize (points) to the score of the player to generate the game data.

In another case, when several players select the on-line mode, the on-line mode differs from the single-player mode in that the game server 8 can activate the basketball machines of all players at the same time. In this regard, as the processor 5 of one of the basketball machines determines that the scoring signal has been received within a predetermined period of time following the moment of contact between the reference object A and the predetermined moving object I (which contains a bonus prize of N points), the player of the basketball machine is credited with the bonus prize (N points) specified by said moving object I, and/or the score(s) of the other player(s) is subtracted by the N points as specified by the bonus prize.

The dispensing step S3 is configured to display the game data in the plurality of display areas M as performed by the processor 5. Preferably, in the single-player mode, the dispensing step S3 can be performed by the processor 5 to control the token dispenser 17 to dispense a number of token tickets according to the total score specified in the game data.

The analysis step S4 is configured to determine whether the score as specified in the game data reaches what is required for completing the challenge, as performed by the processor 5. If so, the processor 5 controls the basketball machine to enter the next challenge. If not, the processor 5 controls the basketball machine to stop the game. The processor 5 further controls the token dispenser 17 to dispense a number of token tickets according to the game data under the single-player mode.

The control method for the basketball machine according to the invention may further include a setting step S0 configured to set the requirements of completing the individual challenges as performed by the processor 5. In this embodiment, the processor 5 sets three challenges requiring the player to achieve the scores of 40, 60 and 80 to complete the challenges, respectively. The required scores for completing the individual challenges can be determined independently, or can be determined in an accumulated manner. The game time may be set as 60 seconds, but is not limited thereto.

As the player goes through the game challenge-by-challenge, the processor 5 may increase the required score of the next challenge as well as the movement speed, the quantity, and the plurality of bonus prizes of the plurality of moving objects I on a challenge-by-challenge basis. In this mechanism, the plurality of moving objects I moves quicker in the next challenge than in the current challenge; the plurality of moving objects I moves even more quicker in the challenge following the next and so on. Similarly, there are more moving objects I in the next challenge than in the current challenge; there are even more moving objects I in the challenge following the next and so on. Likewise, the plurality of moving objects I contains higher bonus prizes in the next challenge than in the current challenge; the plurality of moving objects I contains even higher bonus prizes in the challenge following the next and so on. In a preferred case, when the remaining time in the challenge is lower than a threshold value, the processor 5 further increases the movement speed, the quantity, and the bonus prizes of the plurality of moving objects I. Based on this, once the current challenge is completed and the game proceeds to the next challenge, the processor 5 sets the movement speed, the quantity, and the bonus prizes of the plurality of moving objects I to the predetermined values of the following challenge.

In the single-player mode, the processor 5 can display an instant amount of bonus points in one of the plurality of display areas M. Each time the game is finished, the processor 5 adds a number of bonus points to the instant amount of bonus points. The bonus points continuously accumulate until they are won as a progressive jackpot prize by a player. The accumulated bonus points can be exchanged for a corresponding number of token tickets. Once the jackpot prize is won, the processor 5 resets the number of the bonus points to the initial value, which is 100 (not limited) in this embodiment. In a further embodiment, when the processor 5 determines that the score of the player reaches the final challenge, the bonus prize of a predetermined one of the plurality of moving objects I can include the progressive jackpot prize as well as a number of points (to be added to the instant score of the player) and/or a number of token tickets (to be added to the instant amount of the token tickets of the player). In this regard, the processor 5 determines whether the scoring signal has been received within a predetermined period of time following the moment of contact between the predetermined moving object I and the reference object A. If so, the player is awarded with the progressive jackpot prize as well as the number of points and/or the number of token tickets in recognition of his/her outstanding achievement.

Based on the above, the basketball machine and the control method therefor according to the invention can display the game, including the reference object and the plurality of moving objects, on a display while controlling the plurality of moving objects to move towards and past the reference object. In this regard, the processor credits the player with the bonus prize when determining that the scoring signal has been received within a predetermined period of time following the moment of contact between the moving object and the reference object. Accordingly, the basketball machine and the control method therefor according to the invention can improve the entertaining effect in playing the game.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A control method for a basketball machine, wherein the basketball machine includes a body, a display, a hoop, a sensor and a processor, wherein the display and the hoop are connected to the body, wherein the sensor is connected to the hoop, wherein the processor is electrically connected to the display and the sensor, wherein the control method comprises:

activating the basketball machine by the processor;

controlling the display to display a game having a plurality of challenges by the processor;

generating a plurality of display areas, a reference object and a plurality of moving objects on a first image layer of the game by the processor;

setting a bonus prize for each of the plurality of moving objects in a random manner by the processor;

controlling the plurality of moving objects to move towards and past the reference object by the processor;

detecting whether there is a ball passing through an opening of the hoop by the sensor;

generating a scoring signal by the sensor when the detected result is positive;

calculating an accumulated number of times the scoring signal has been received by the processor;

converting the accumulated number into an instant score by the processor;

determining whether the scoring signal has been received by the processor within a predetermined period of time following the moment of contact between the reference object and one of the plurality of moving objects;

crediting a player with the bonus prize of the one of the plurality of moving objects when the determined result is positive;

adding the bonus prize of the one of the plurality of moving objects to the instant score of the player by the processor to generate a game data;

displaying the game data on the plurality of display areas by the processor;

determining whether the game data reflects a condition qualifying as completing a current one of the plurality of challenges by the processor; and controlling the basketball machine to enter a next one of the plurality of challenges following the current challenge by the processor when the game data reflects the condition qualifying as completing the current challenge.

2. The control method for the basketball machine as claimed in claim 1, further comprising increasing a required score of the next one of the plurality of challenges and a movement speed, a quantity and the bonus prize of each of the plurality of moving objects by the processor.

3. The control method for the basketball machine as claimed in claim 1, wherein the bonus prize of the one of the plurality of moving objects is a number N that is randomly determined, wherein adding the bonus prize includes increasing the instant score of the player by N points and/or an instant amount of token tickets of the player by the number N as performed by the processor.

4. The control method for the basketball machine as claimed in claim 1, wherein the game further includes a second image layer under the first image layer, wherein controlling the display to display the game further includes displaying an animated background on the second image layer.

5. The control method for the basketball machine as claimed in claim 1, wherein setting includes setting the bonus prize of another of the plurality of moving objects as a progressive jackpot prize by the processor when the instant score of the player reaches a required score of a final one of the plurality of challenges, and wherein crediting the player includes, when the scoring signal has been received by the processor within the predetermined period of time following the moment of contact between the reference object and the other of the plurality of moving objects, crediting the player with the progressive jackpot prize as well as a number of points and/or a number of token tickets.

6. A basketball machine, comprising:

a body having an inclined lane;

a display connected to the body and configured to display a game having a plurality of challenges, wherein the display has a first image layer showing a plurality of display areas, a reference object and a plurality of moving objects, wherein the plurality of moving objects moves towards and past the reference object, and wherein each of the plurality of moving objects has a bonus prize generated in a random manner;

a hoop including an engagement portion engaged with the body and having an opening;

a sensor connected to the hoop and configured to detect whether a ball has passed through the opening, wherein the sensor generates a scoring signal when the detected result is positive; and a processor electrically connected to the display and the sensor, wherein the processor calculates an accumulated number of times the scoring signal has been received and converts the accumulated number into an instant score, wherein the processor determines whether a game data reflects a condition qualifying as completing a current one of the plurality of challenges according to the instant score and the bonus prize, wherein the processor controls the game to enter a next one of the plurality of challenges following the current one of the plurality of challenges when the determined result is positive, wherein the processor determines whether the scoring signal has been received within a predetermined period of time following the moment of contact between the reference object and one of the plurality of moving objects, wherein the processor credits a player with the bonus prize of the one of the plurality of moving objects when the determined result is positive, wherein the processor adds the bonus prize of the one of the plurality of moving objects to the instant score of the player to generate the game data, and wherein the processor displays the game data on the plurality of display areas.

7. The basketball machine as claimed in claim 6, wherein the body includes a stopper board movably disposed in a recess of the inclined lane, and wherein the stopper board is able to retract in or extend out of the recess of the inclined lane.

8. The basketball machine as claimed in claim 6, further comprising a stopper member including a first stopper unit, wherein the first stopper unit is coupled with a backboard and disposed over the opening of the hoop.

9. The basketball machine as claimed in claim 8, wherein the stopper member further includes a second stopper unit sandwiched between two lateral boards of the body, and wherein a bottom of the second stopper unit is spaced from a surface of the inclined lane at a minimum gap allowing for passage of the ball.

* * * * *